United States Patent [19]

Suda

[11] 4,366,799

[45] Jan. 4, 1983

[54] EXHAUST GAS RECIRCULATOR

[75] Inventor: Koichi Suda, Aichi, Japan

[73] Assignee: Aisan Kogyo Kabushiki Kaisha, Japan

[21] Appl. No.: 238,000

[22] Filed: Feb. 24, 1981

[30] Foreign Application Priority Data

Oct. 31, 1980 [JP] Japan ..... 55-154122

[51] Int. Cl.[3] ..... F02M 25/06

[52] U.S. Cl. ..... 123/568

[58] Field of Search ..... 123/568

[56] References Cited

U.S. PATENT DOCUMENTS

| | | | |
|---|---|---|---|
| 4,149,503 | 4/1979 | Ozaki et al. | 123/568 |
| 4,158,351 | 6/1979 | Ando et al. | 123/568 |
| 4,192,264 | 3/1980 | Arnaud | 123/568 |
| 4,224,912 | 9/1980 | Tanaka | 123/568 |
| 4,233,946 | 11/1980 | Yorioka et al. | 123/568 |

*Primary Examiner*—Wendell E. Burns

*Attorney, Agent, or Firm*—Blair, Brown & Kreten

[57] ABSTRACT

An exhaust gas recirculator for an internal combustion engine having an exhaust pipe, an intake manifold and a carburetor throttle valve. The exhaust gas recirculator comprises an EGR passage which makes the exhaust pipe communicate with the intake manifold, an EGR controlling valve and an EGR valve respectively arranged in the upper and lower portions of the EGR passage. The EGR valve operates in association with the carburetor throttle valve for metering the flow of EGR gas. The EGR controlling valve is separated by a diaphragm into an EGR gas chamber communicating with the EGR passage between the EGR controlling valve and the EGR valve and a negative pressure chamber communicating with the intake manifold. The negative pressure chamber contains a compression spring, and the diaphragm is connected with a valve member through a rod upon which is disposed a stopper to serve as a different seal in place of the valve member to close off the exhaust gas passage, which valve member and stopper are constructed to be opened and closed by pressure difference between the EGR gas chamber and the negative pressure chamber and by elastic force of the compression spring. The EGR controlling valve functions to control the pressure difference around the EGR valve to be constant.

3 Claims, 1 Drawing Figure

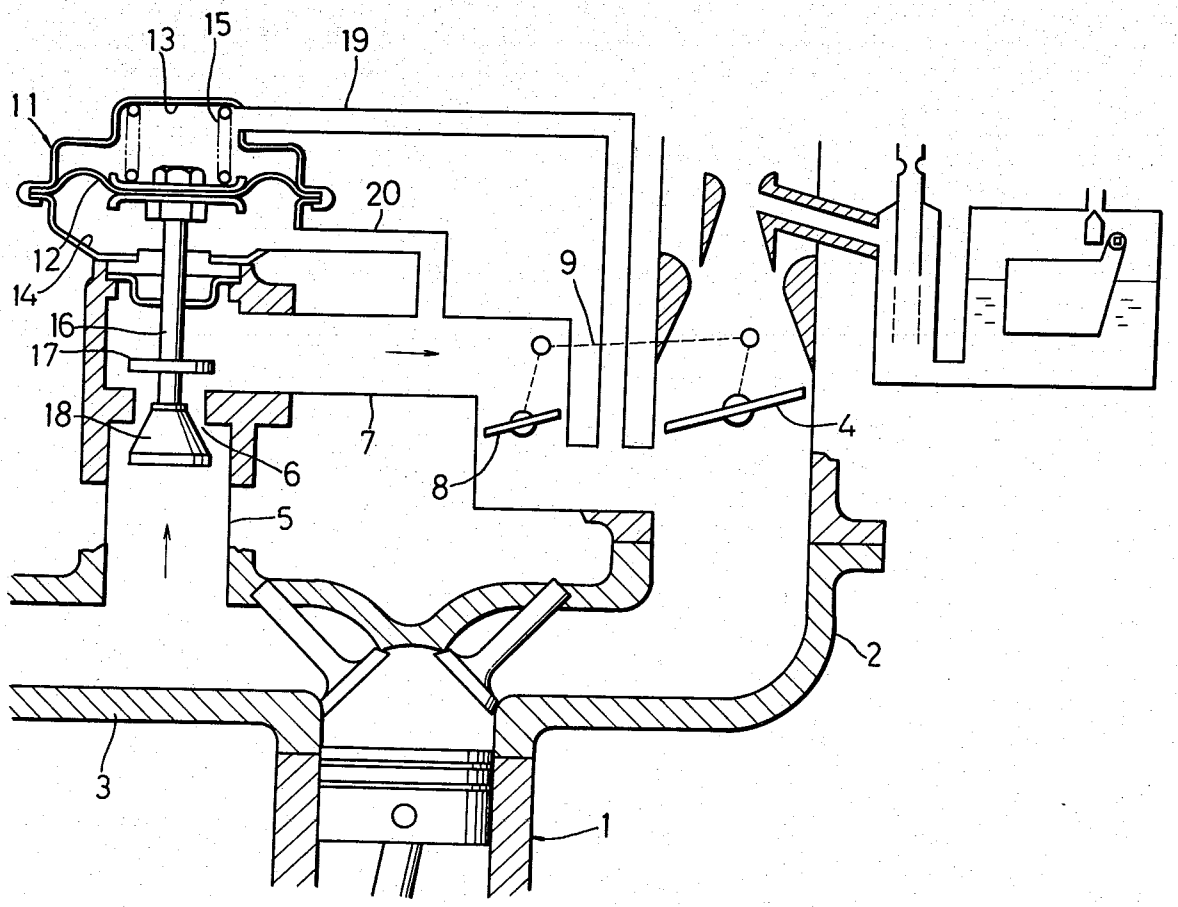
1
2
3
4
5
6
7
8
9
11
12
13
14
15
16
17
18
19
20

EXHAUST GAS RECIRCULATOR

BACKGROUND OF THE INVENTION

1. Field of the Invention

The present invention relates to an exhaust gas recirculator for an internal combustion engine (hereinafter referred to as "engine") for an automobile in which the combustion temperature in the engine is lowered to reduce nitric oxide contained in the exhaust gas.

2. Description of the Prior Art

In a conventional exhaust gas recirculator detecting exhaust gas pressure, a vacuum modulator detects exhaust gas pressure in a pressure chamber and negative pressure in the upstream portion of a carburetor throttle valve so that the diameter of a variable throttle is changed with a valve member to generate a negative pressure signal toward an EGR controlling valve. Following the negative pressure signal, opening of a valve member of the EGR controlling valve is regulated to meter the flow of recirculation of the exhaust gas. However, the exhaust gas in the pressure chamber involves pressure variation, which is also detected directly by the vacuum modulator, and the exhaust gas thus metered flows into an intake manifold involving the pressure variation.

Thus, the variation in the exhaust gas pressure exerts influence upon the exhaust gas recirculation metering portion, and therefore accuracy in metering of the exhaust gas is lowered and operation efficiency of the engine is deteriorated.

Further, when the exhaust gas is recirculated in the conventional exhaust gas recirculator in case opening of the carburetor throttle valve is small, normal combustion cannot be achieved since the mixture is excessively diluted by inert gas while the output of the engine is lowered when the exhaust gas is recirculated in case the carburetor throttle valve is substantially fully open.

SUMMARY OF THE INVENTION

It is an object of the present invention to provide an exhaust gas recirculator in which accuracy in metering of exhaust gas recirculation is improved with no influence of pressure variation in the exhaust gas.

It is another object of the present invention to provide an exhaust gas recirculator which can stop exhaust gas recirculation when opening of a carburetor throttle valve is small or the same is substantially fully open.

The exhaust gas recirculator according to the present invention has an EGR valve for metering exhaust gas substituted for the vacuum modulator so that an EGR controlling valve itself detects pressure difference around the EGR valve to control the pressure and maintain the pressure difference constant, and thereby improves accuracy in metering of the exhaust gas and prevents lowering of operation efficiency of the engine.

Further, in the exhaust gas recirculator according to the present invention, exhaust gas recirculation is stopped by closing of an EGR controlling valve when opening of a carburetor throttle valve is small or the same is substantially fully open so as to fulfil its optimum function.

BRIEF EXPLANATION OF THE DRAWING

The accompanied FIGURE is a longitudinal cross sectional view of an exhaust gas recirculator according to the present invention.

DESCRIPTION OF THE PREFERRED EMBODIMENT

Referring now to the accompanying drawing showing an embodiment of the exhaust gas recirculator according to the present invention, numeral 1 indicates an engine which has an intake manifold 2 and an exhaust pipe 3. The volume of air to be sucked in the intake manifold 2 is metered by a carburetor throttle valve 4. Part of the exhaust gas is extracted from the exhaust pipe 3 and flows through an EGR passage comprising an EGR inlet 5, a throttle portion 6 and a pressure chamber 7 to be metered by an EGR valve 8 and recirculated to the intake manifold 2. The EGR valve 8 is mechanically connected with the carburetor throttle valve 4 by a link 9 so that the opening area ratio of the EGR valve 8 and the carburetor throttle valve 4 is continuously maintained constant. The area of the throttle portion 6 is controlled by an EGR controlling valve 11 which is separated by a diaphragm 12 into a negative pressure chamber 13 and an EGR gas chamber 14. A spring 15 is mounted within the negative pressure chamber 13 to press the diaphragm 12 toward the EGR gas chamber 14. An end of a rod 16 is secured to the central portion of the diaphragm 12 while the other end of the rod 16 is provided with a stopper 17 and a valve member 18, which is inserted into the throttle portion 6. The negative pressure chamber 13 communicates with the intake manifold 2 through a negative pressure passage 19, and the EGR gas chamber 14 communicates with the pressure chamber 7 through an exhaust pressure communicating passage 20.

In the exhaust gas recirculator of the above construction, the exhaust gas extracted from the exhaust pipe 3 passes through the EGR inlet 5, the throttle portion 6, the pressure chamber 7 and the EGR valve 8 to be recirculated to the intake manifold 2. The amount of recirculation of the exhaust gas is determined by the area of opening SE of the EGR valve 8 and pressure difference P−Pb, in which P indicates exhaust gas pressure in the pressure chamber 7 and Pb indicates intake negative pressure in the intake manifold 2. The amount of intake air is determined by the area of opening ST of the carburetor throttle valve 4 and pressure difference Po−Pb in which Po indicates the pressure of air in the upstream portion of the throttle valve 4. Consequently, the ratio R of the amount of recirculation of the exhaust gas and the amount of intake air is in proportion to:

$$\frac{SE}{ST}\ \frac{\sqrt{P-Pb}}{\sqrt{Po-Pb}}.$$

On the other hand, the EGR controlling valve 11 for controlling the flow of the exhaust gas passing through the throttle portion 6 controls the pressure P in the pressure chamber 7 by moving the valve member 18 so that the pressure difference P−Pb relating to the negative pressure chamber 13 and the EGR gas chamber 14 separated by the diaphragm 12 is balanced with constant value PS/SD which is determined by effective area SD of the diaphragm 12 and fitting load PS of the spring 15. When the intake negative pressure Pb is high, i.e., the absolute value is large, the valve member 18 is raised to reduce the amount of intake of the exhaust gas and lower the pressure P−Pb of the pressure chamber 7 so that the value P−Pb is maintained constant. When the intake negative pressure Pb is low, i.e., the absolute value is small, the valve member 18 is lowered to increase the amount of intake of the exhaust gas and raise the pressure P of the pressure chamber 7 so that the value P−Pb is maintained constant. Thus, the pressure difference P−Pb around the EGR valve 8 for metering the amount of recirculation of the exhaust gas to be supplied to the intake manifold 2 is continuously maintained constant.

Further, the ratio of the area of opening SE/ST is also maintained constant since the EGR valve 8 is connected with the carburetor throttle valve 4 by the link 9.

As the result, the ratio R between the amount of recirculation of the exhaust gas and the amount of intake air is in proportion to:

$$\frac{C}{\sqrt{Po - Pb}}$$

in which C indicates a constant. Namely, exhaust gas recirculation metering can be conducted without being influenced by variation in the exhaust gas pressure P. When the intake negative pressure Pb is high, the valve member 18 is raised to reduce the amount of exhaust gas recirculation and when the intake negative pressure Pb is low, the valve member 18 is lowered to increase the amount of exhaust gas recirculation. However, when the intake negative pressure Pb becomes lower than predetermined value, the valve member 18 is lowered so that the stopper 17 blocks the throttle portion 6 to stop recirculation of the exhaust gas.

While the invention has been described with reference to a preferred embodiment thereof, it is to be understood that modifications or variations may be easily made without departing from the scope of this invention which is defined by the appended claims.

What is claimed is:

1. An exhaust gas recirculator for an internal combustion engine having an exhaust pipe, an intake manifold and a carburetor throttle valve, said exhaust gas recirculator comprising an EGR passage making said exhaust pipe communicate with said intake manifold, an EGR controlling valve and an EGR valve respectively arranged in the upper and lower stream portions of said EGR passage, said EGR valve operating in association with said carburetor throttle valve for metering the flow of EGR gas, said EGR gas chamber communicating with said EGR passage between said EGR controlling valve and said EGR valve and a negative pressure chamber communicating with said intake manifold, said negative pressure chamber containing a compression spring, said diaphragm being connected with a rod member, said rod member being provided on the free end thereof with a reversely tapered cone valve member inserted into the throttle portion in the upper stream of said EGR passage and provided with a lid type stopper downstream of said throttle portion, said EGR controlling valve functioning to control said pressure difference around said EGR valve to be constant.

2. The invention as defined in claim 1 wherein said EGR valve is mechanically connected with said throttle valve by a link.

3. The invention as defined in claim 1 wherein said compression spring presses said diaphragm against said EGR gas chamber.

* * * * *